United States Patent [19]

Smolnik

[11] Patent Number: 4,711,180

[45] Date of Patent: Dec. 8, 1987

[54] MORTAR TRAINING DEVICE WITH FUNCTIONAL SIMULATED PROPELLING CHARGES

[76] Inventor: John Smolnik, 81 Leamoor Dr., Parsippany, N.J. 07054

[21] Appl. No.: 915,566

[22] Filed: Oct. 6, 1986

[51] Int. Cl.[4] ..... F42B 13/22

[52] U.S. Cl. ..... 102/445; 102/498; 102/529; 102/372

[58] Field of Search ..... 102/495, 498, 372, 373, 102/529

[56] References Cited

U.S. PATENT DOCUMENTS

| | | | |
|---|---|---|---|
| 2,821,923 | 2/1958 | Alderson | 102/529 |
| 3,085,509 | 4/1963 | Brandt | 102/445 |
| 3,374,738 | 3/1968 | Gawlick et al. | 102/372 |
| 4,109,519 | 8/1978 | Carter | 102/445 |
| 4,549,487 | 10/1985 | Jensen | 102/498 |

*Primary Examiner*—Harold Tudor

[57] ABSTRACT

A mortar training device which includes full-size, simulated, propelling charges is disclosed. The device enables a trainee to subtract simulated charges, as required, to achieve a desired zone of reduced firing distance, following procedures similar to those used with standard service ammunition. The method is embodied in a sabot projectile having a sub-caliber flight projectile. The system provides zones of firing distance which are approximately one-tenth that of standard service ammunition.

6 Claims, 6 Drawing Figures

MORTAR TRAINING DEVICE WITH FUNCTIONAL SIMULATED PROPELLING CHARGES

BACKGROUND OF THE INVENTION

This invention relates to a class of mortar training devices which are fired to approximately one-tenth the distance of service ammunition. The devices are intended to provide realistic mortar firing training, at low cost, using a standard mortar, standard sighting and fire control equipment, and a special firing table in the same manner as standard service mortar ammunition. In particular, the invention relates to a method of realistically simulating a standard propelling charge system including appearance, handling, operating procedures, and functions in a mortar training device.

Propelling charges for service use are typically horseshoe-shaped and stacked in a group of four charges about the boom of a fin-stabiized mortar projectile. The charges are assembled to the boom through the open end of the horse-shoe and snapped in place. Each charge may be removed indivually. Removal of one or more charges prior to drop-firing the projectile reduces the velocity of the projectile and thereby foreshortens flight time and distance of impact. Each velocity level is identified as a charge zone number, according to the number of charges employed, including Charge 0 where all charges are absent and only the ignition cartridge propels the projectile out of the weapon.

An effective training system permits or requires the trainee to perform a complete sequence of procedures in the same way as with standard service ammunition, with as much similarity in appearance, handling, feel and functionality of the materiel as is feasible, and with safety and low cost.

A major shortcoming of existing training devices is their inability to achieve the desired realism in handling and adjustment of propelling charges for zoning. Examples of this deficiency may be found with training devices in current use for the 81 mm mortar system, viz., the M880 Training Cartridge, and the M1 Sabot with 22 mm Sub-caliber Practice Cartridges M744, M745, M746 and M747.

The M880 Training Cartridge consists of a kit of expendable component assemblies and a full-size flight projectile of limited reusability. The kit contains a fuze w/ spotting charge, an ignition cartridge, and small plastic plugs. The components of the kit are pre-assembled in the field to the projectile. The small plugs are inserted into the inlet end of gas exhaust ports, the latter located in the main body of the flight projectile.

The trainee selects a desired charge zone by removing an appropriate number of plugs from the projectile prior to drop firing. The unplugged gas ports exhaust a portion of the propelling gases through the projectile body to debilitate energy delivered to the projectile.

The act of removing the plugs and checking the number of plugs remaining in-place prior to drop firing purports to correspond with service procedures for removal and checking of propelling charges. However, the plug arrangement fails in simulating size, configuration, locale, and method of removal relative to that of standard service propelling charges. Accordingly, the M880 Training Cartridge is deemed to lack the desired realism in this aspect of training.

The alternative M1 Sabot system with its sub-caliber cartridges is a training device which employs a sub-caliber flight projectile housed within a sabot projectile. The system fires the subcaliber projectile to a desired distance, while the sabot projectile is ejected a few yards from the mortar weapon. The subcaliber projectile contains a fuze and spotting charge to permit sighting of impact.

The M1 system has no means for ajusting the charge to achieve the desired range distance zoning. Instead, the trainee selects a specific sabot projectile which is pre-fitted with a sub-caliber cartridge having the appropriate charge level. The trainee is able to discriminate between the charge level of each projectile by inspection of identifying notches at the exposed base of each cartridge.

While both existing systems provide a means for selecting a charge zone, neither system provides the desired realism in simulating service conditions with respect to appearance and handling of propelling charges, viz., size, configuration and location of the charges, method of attachment to the boom of the projectile, technique for removal, and means for visual or nonvisual inspection.

SUMMARY

The principle object of this invention is to provide an effective and inexpensive device suited for mortar gunnery training which addresses the need for adequately simulating service procedure in the handling and manipulation of propelling charges.

The invention solves the problem in an embodiment of a sabot projectile of full-bore size utilizing an internally housed system of a sub-caliber flight projectile and propelling cartridge, in combination with the following enabling methods and features: (1) utilization of the principle of exhausting gas from a chamber through control ports to debilitate energy delivered to a receptor, viz., the sub-caliber flight projectile, (2) interposition of a gas chamber of adequate volume between the propelling cartridge and the sub-caliber projectile, including a hollow boom section, (3) inclusion of gas control ports through the wall of the boom, arranged in a line on one side of the boom in positions substantially corresponding to the locations of standard propelling charges in service ammunition, (4) utilization of simulated charges, substantially similar in size and configuration to service propelling charges, designed to serve as plugs for the gas control ports when the charges are affixed to the boom, (5) provision for an integral means to retain any affixed charges against pressure tending to dislodge the charges via their plugging members, (6) provision for elevating the pressure in the propelling cartridge to substantially consume the propellant prior to partially expanding the propellant gases into the operating chamber including the boom channel, (7) inclusion of a permanently open supplemental port to pass gas from the operating chamber of the sub-caliber system to the chamber of the mortar weapon to assure ejection of the sabot projectile out of the mortar tube.

A further object of the invention is to segregate those subsystems from the expendable propelling cartridge which can feasibly be modified and conveniently made part of the reusable sabot projectile in order to reduce the per-shot cost of the training device.

These objects of the invention will become apparent to persons skilled in the arts and techniques of mortar gunnery or design of mortar ammunition by reference to the following description when taken with the accompanying drawings which illustrate the invention principle.

DESCRIPTION

Figures 1, 2:
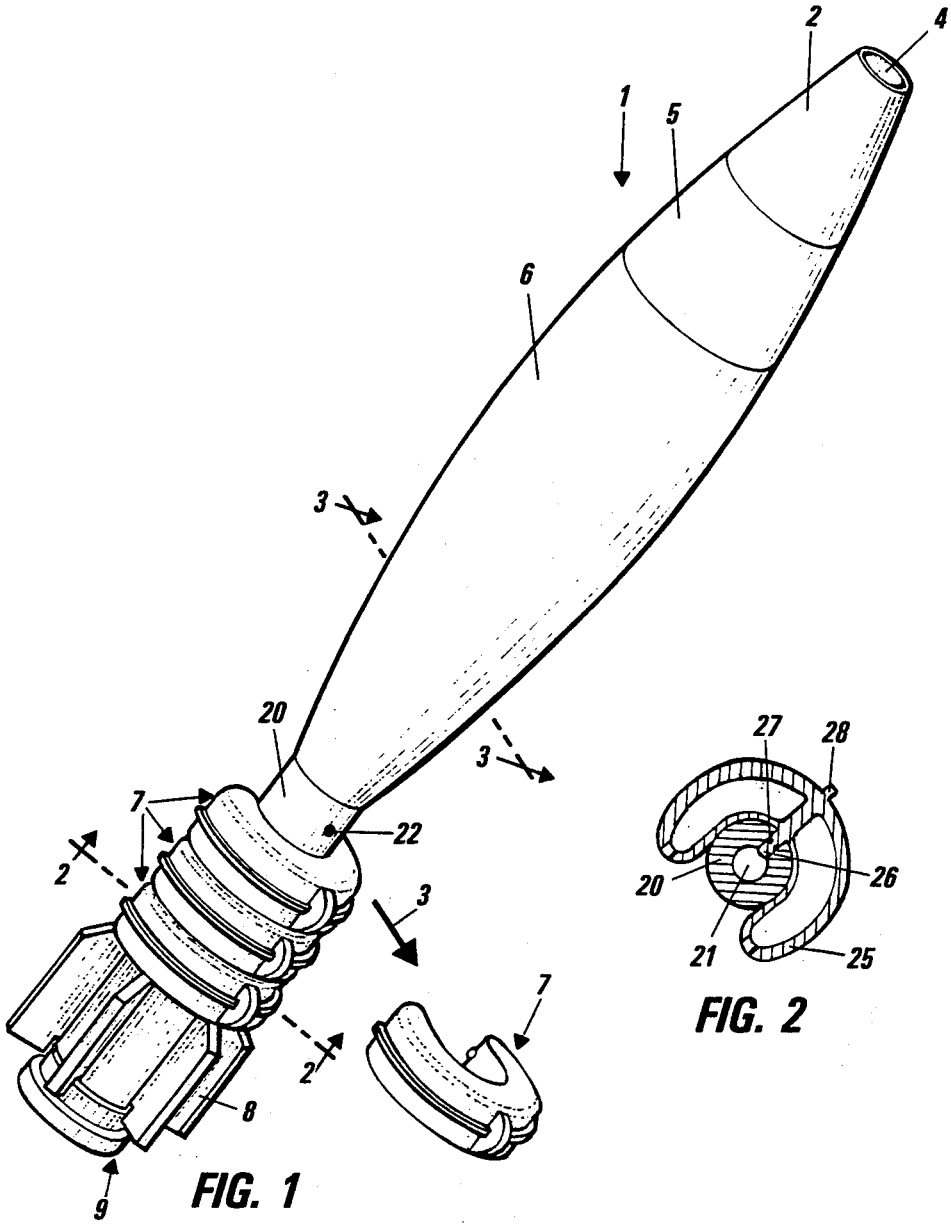
FIG. 1 is a perspective view of a mortar training device according to a typical embodiment of the present invention illustrating the use of full-size simulated propelling charges attached to the boom of the device. One of four simulated charges is shown removed from the boom.
FIG. 2 is a transverse sectional view taken along line 2—2 of FIG. 1 training device, through a simulated charge attached to the boom of the device.

Referring to FIG. 1, there is illustrated a mortar training device 1 which is similar in size, weight and external configuration to a service mortar cartridge. The externally visible portions of training device 1 of FIG. 1 are dummy fuze cap 2, the muzzle portion of sub-caliber bore 4, sabot nose member 5, sabot body 6, boom 20, a stack of simulated propelling charges 7, fin member 8, and cartridge retainer assembly 9. One of four simulated charges 7 is shown removed from boom 20, exposing control gas port 22.

Figure 3:
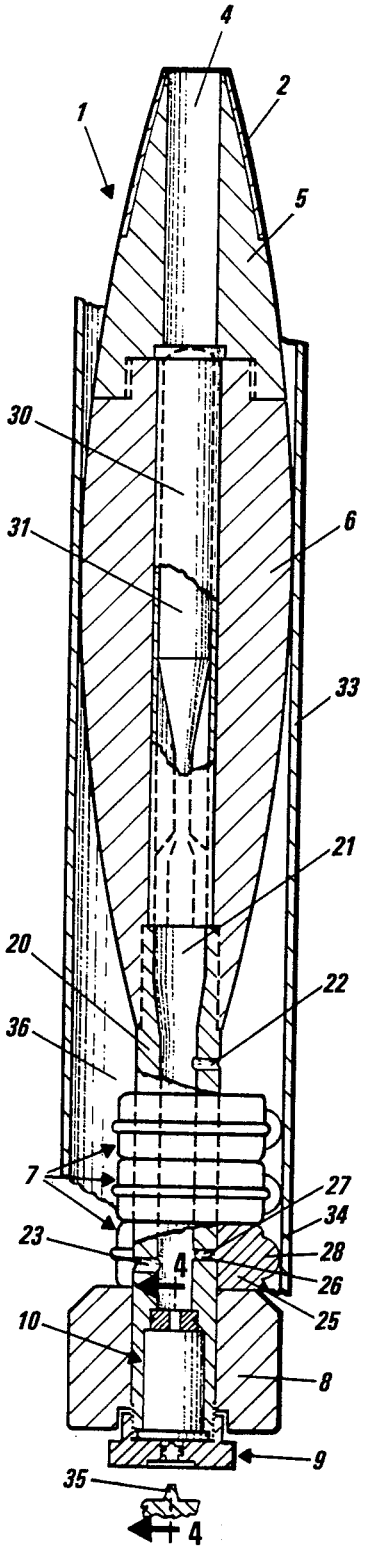
FIG. 3 is substantially a sectional view taken along the line 3—3 of FIG. 1 training device, illustrating the locations of the propelling cartridge, gas ports, including a supplementary gas port, and the sub-caliber container in partial cutaway. A portion of a typical mortar weapon is added, showing the training device in near contact with the firing pin, and illustrating the proximity of the simulated charge to the wall of the mortar tube.
Figure 4:
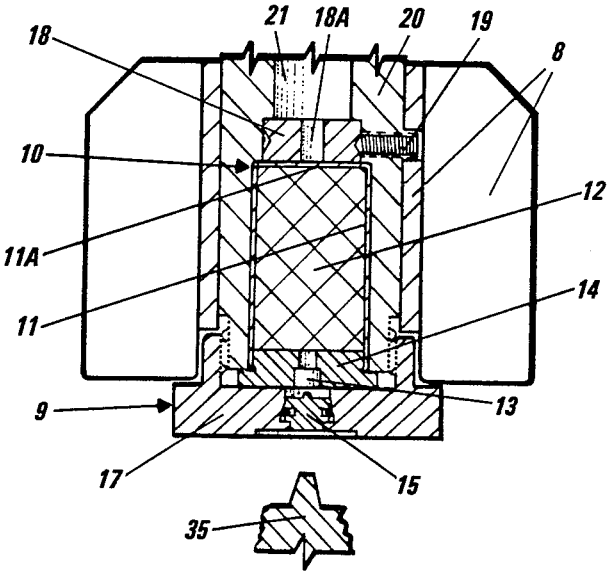
FIG. 4 is a partial sectional view taken along the line 4—4 of FIG. 3 partially detailing the cartridge retainer assembly, the propelling cartridge, and orifice member.

Referring to FIG. 3, training device 1 is shown in a drop-fire position in mortar tube 33, falling toward mortar firing pin 35. Referring to FIG. 4, upon striking firing pin 35, firing plug 15 strikes percussion primer 13 igniting propellant 12. As pressure within case 11 builds up, end member 11A of case 11 is sheared through orifice 18A. Propellant gases, and residual unburnt propellant 12, pass through orifice 18A and partially expand into chamber 21.

Referring to FIG. 3, pressure in chamber 21 acts on sub-caliber projectile 31, which is packaged within casing 30, to accelerate projectile 31 out of its casing 30 and through bore 4 for flight to a desired impact distance. Simultaneously, propellant gases pass through supplementary gas port 23 and through any unplugged gas control ports 22. The resulting overpressure in mortar chamber 36 acts on residual training device 1 to eject it out of mortar tube 33 a few yards from the weapon. Periodically, the spent training devices are gathered for reloading and reuse.

Control of the impact distance of sub-caliber flight projectile 31 is achieved by adjusting the firing elevation angle of the weapon in combination with selection of one of several available firing velocity levels. The relative magnitude of each velocity level qualitatively corresponds to the number of simulated charges 7 affixed to training device 1 when drop-fired.

Referring to FIG. 2 and FIG. 3, simulated charge 7 includes body 25, substantially similar in size and configuration to a standard propelling charge, plugging member 26 with seal 27, and projecting member 28. Simulated charge 7 is affixed to boom 20 by guiding plugging member 26 into port 22 while clipping the open end of the charge about boom 20. A full complement of simulated charges 7 are pre-affixed in preparation for use in training. A trainee selects the desired velocity level by removing an appropriate number of simulated charges 7 from boom 20 in reverse procedure as the affixing method. This charge removal procedure is similar to that used with service ammunition.

Typical selectable velocity levels may include a minimum of 115 feet per second at "Charge 0" where all simulated charges 7 are removed, to a maximum of 250 feet per second at "Charge 4" where none are removed and all four simulated charges are present. The resultant maximum flight distance capabilities are then approximately 100 meters at Charge 0 to approximately 500 meters at Charge 4, distances which are generally suited for training purposes. However considerable flexibility is present within the gas porting method in combination with a sub-caliber projectile to design for a wider or narrower spread between minimum and maximum velocities. Intermediate velocity levels would be represented by Charges 1, 2, and 3. The preferred embodiment would contain control ports 22 of identical diameter to permit design commonality and interchangeability of simulated charges 7.

Referring to FIG. 3, control ports 22 are positioned in a line on one side of boom 20, on centers substantially equal to the height of each simulated charge 7, the aft port located such that an affixed simulated charge 7 will substantially abut fin 8. Supplemental port 23 is shown in close proximity to fin 8 so as to preclude inadvertent affixing of simulated charge 7 to this port. The radial location of supplemental port 23 is 180 degrees from control ports 22 to allow gases to exit supplemental port 23 in the opening of aft charge 7 if present.

Figure 5:
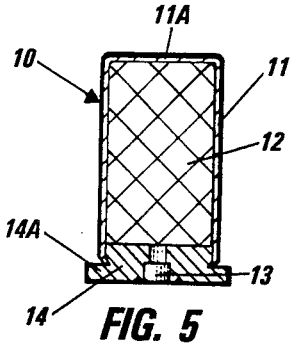
FIG. 5 is a sectional view as in FIG. 4 of the propelling cartridge alone.
Figure 6:
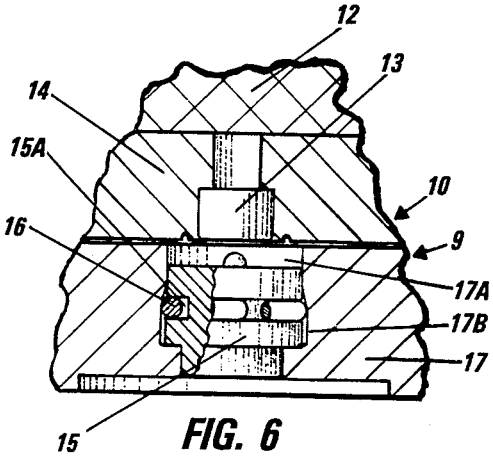
FIG. 6 is a partial sectional view enlarging the initiating portions of FIG. 4 to better illustrate the method of retaining the firing plug in its fully seated position.

FIG. 5 illustrates the elements of propelling cartridge 10 including percussion primer 13, cartridge base 14, flange member 14A of cartridge base 14, case 11, case end member 11A, and propelling charge 12. Cartridge 10 is shorn of certain features which are essential for reliable performance of a stand-alone cartridge in a similar role. Instead these essentials are cooperatively included in the reusable portions of training device 1 in the interest of reducing the cost of cartridge 10, an expendable, one-shot assembly. Referring to FIG. 4 and FIG. 6, one feature, firing plug 15, is relocated to cartridge retainer assembly 9. A similar firing plug is used in 81 mm service ammunition as part of its ignition cartridge, thus use of firing plug 15 is intended to provide additional commonality with service ammunition for training purposes. However firing plug 15 is modified for its reusable role with circumferential groove 15A to receive snap ring 16. Firing plug 15 with snap ring 16 is cooperatively arranged within cavity 17A of retaining body 17 and adjacent to shallow groove 17B to normally retain firing plug 15 in a fully seated position within cavity 17A as shown in FIG. 6.

Another feature essential to the reliable performance of propelling cartridge 10 is orifice member 18 which controls the maximum pressure level in propelling cartridge 10 in cooperation with the strength and thickness of end casing 11A. A means of elevating pressure is necessary to minimize the quantity of unburnt propellant entering chamber 21 due to the relatively large free volume of the chamber and the presence of exhaust ports. This system of pre-burning the propellant at high pressure and then passing the gases to a large chamber is termed a "highlow" system which is found in various ammunition with the orifice feature integral with the the ammunition rather than with the weapon (reusable materiel). In the embodiment shown, orifice member 18 is secured by retaining screw 19 to boom 20. Member 18 is constructed of a durable material to withstand repeated usage in the erosive environment of high pressure and temperature gas flow.

I claim:

1. A mortar training device similar to a service mortar cartridge for use in a standard mortar comprising, in combination;

a reusable sabot projectile of nominal mortar bore diameter including a body having a small caliber bore, a hollow boom joined axially to said body, a fin section joined axially to said boom;

a subprojectile accommodated within said small caliber bore of said sabot projectile body;

a propelling gas means for propelling said subprojectile including a propellant charge, said propelling gas means contained in said sabot projectile;

a charge initiating means including a percussion primer located aft of said propelling gas means;

a subchamber comprised of free volume within said sabot projectile aft of said subprojectile wherein subchamber gases are received from said propellant charge to propel said subprojectile;

a mortar chamber comprised of free volume within said mortar adjacent said sabot projectile;

a propelling gas egress means including a plurality of gas control ports connecting said subchamber and said mortar chamber for reducing subchamber gas pressure;

a plugging means including manually and individually removable plugs to block said gas control ports;

a plug retaining means to prevent said plugs from being dislodged by said subchamber gas pressure;

a sabot projectile expelling means including said propelling gas means, and a supplemental gas port means for discharging gases into said mortar chamber to eject said sabot projectile, said sabot projectile expelling means being essential when all said gas control ports are plugged.

2. The device of claim 1 wherein;

said supplemental gas port means includes a gas passage between said subchamber and said mortar chamber;

said propelling gas means includes a portion of said subchamber gases discharging through said gas passage into said mortar chamber to eject said sabot projectile.

3. The device of claim 1 or 2 wherein said plug retaining means includes a mortar bore riding portion of said plugs.

4. The device of claim 1 or 2 wherein said plugging means is configured to be similar to standard propelling charge increments as in service mortar ammunition having a substantially "U" shape.

5. The device of claim 2 wherein said propelling gas means comprises a means to elevate propellant charge gas pressure prior to discharge of propellant charge gases into said subchamber which includes a reusable orifice member, a propellant cartridge containing said propellant charge, an end casing of said propellant cartridge abutting said orifice member, a gas discharge hole in said orifice member sized in cooperation with a shear strength and thickness of said end casing.

6. The device of claim 2 wherein a reusable means for initiating said percussion primer includes a cylindrical firing plug, a snap ring normally of larger outside diameter than said firing plug assembled into a circumferencial groove of said firing plug, a retainer secured to the rear end of said sabot projectile including an axial cavity cooperatively sized to slidingly receive said firing plug while inwardly squeezing said snap ring, said axial cavity containing a shallow circumferential retaining groove to permit said snap ring to expand into said groove and retain said firing plug in a normally seated position;

whereby a retaining force of said snap ring is overcome upon striking said firing plug by a mortar firing pin allowing said firing plug to initiate said percussion primer;

whereby retention of said firing plug in a fully seated position improves safety in handling and field assembly of said mortar training device.

* * * * *